US011326277B2

(12) United States Patent
Boerstoel et al.

(10) Patent No.: US 11,326,277 B2
(45) Date of Patent: May 10, 2022

(54) PROCESS FOR THE MANUFACTURE OF POLYETHERKETONEKETONE FIBER

(71) Applicants: TEIJIN ARAMID B.V., Arnhem (NL); ARKEMA FRANCE, Colombes (FR)

(72) Inventors: Hanneke Boerstoel, Arnhem (NL); Bert Gebben, Velp (NL); Wido Nijenhuis, Huissen (NL); Julien Jouanneau, Corneville sur Risle (FR); Philippe Bussi, Maisons Laffitte (FR)

(73) Assignee: TEIJIN ARAMID B.V., Arnhem (NL)

( * ) Notice: Subject to any disclaimer, the term of this patent is extended or adjusted under 35 U.S.C. 154(b) by 257 days.

(21) Appl. No.: 16/347,609

(22) PCT Filed: Nov. 8, 2017

(86) PCT No.: PCT/EP2017/078554
§ 371 (c)(1),
(2) Date: May 6, 2019

(87) PCT Pub. No.: WO2018/087121
PCT Pub. Date: May 17, 2018

(65) Prior Publication Data

US 2019/0345643 A1 Nov. 14, 2019

(30) Foreign Application Priority Data

Nov. 8, 2016 (EP) ..... 16197754

(51) Int. Cl.
*D01F 6/66* (2006.01)
*D02G 3/38* (2006.01)
(Continued)

(52) U.S. Cl.
CPC ..... *D01F 6/665* (2013.01); *D01D 5/06* (2013.01); *D02G 3/38* (2013.01); *D02J 13/00* (2013.01)

(58) Field of Classification Search
None
See application file for complete search history.

(56) References Cited

U.S. PATENT DOCUMENTS 3,065,205 A * 11/1962 Bonner, Jr. ..... C08G 61/00 528/180
3,414,645 A 12/1968 Morgan
(Continued)

FOREIGN PATENT DOCUMENTS

EP 0392558 A2 10/1990

OTHER PUBLICATIONS

Jan. 15, 2018 International Search Report issued in International Patent Application No. PCT/EP2017/078554.
(Continued)

*Primary Examiner* — Shawn Mckinnon
(74) *Attorney, Agent, or Firm* — Oliff PLC

(57) ABSTRACT

A process for manufacturing a fiber including polyetherketoneketone including the steps of: mixing polyetherketoneketone and sulfuric acid having a concentration of at least 90 wt % to obtain a spin dope and passing the spin dope through a spinneret into a coagulation bath, wherein the polyetherketoneketone is dissolved in the sulfuric acid to a concentration of 12 to 22 wt %. Also disclosed are fibers obtainable by the process and polyetherketoneketone fibers having a sulfur content of 0.001 to 5 wt %, based on the weight of the fiber, in particular such fibers having low or high crystallinity, as well as, hybrid yarns and composite materials.

10 Claims, 1 Drawing Sheet

Sample 1

Sample 1-3

Sample 1-9

Figure 1:
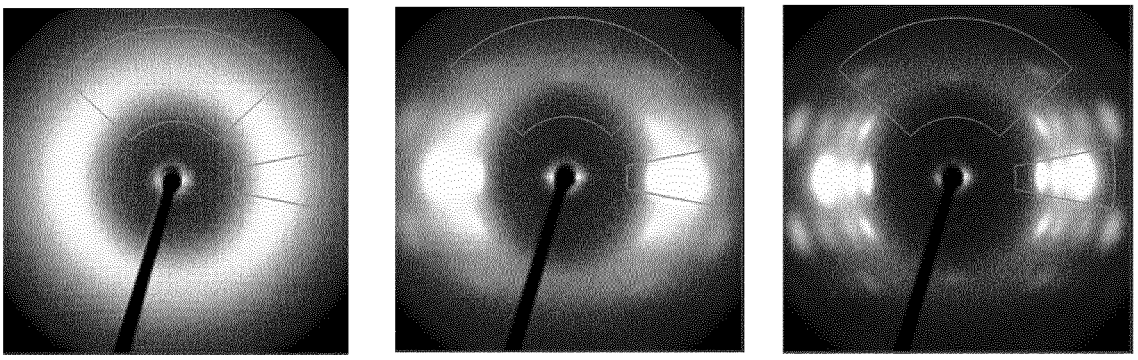

(51) Int. Cl.
*D01D 5/06* (2006.01)
*D02J 13/00* (2006.01)

(56) References Cited

U.S. PATENT DOCUMENTS

| | | | | |
|---|---|---|---|---|
| 3,441,538 | A | 4/1969 | Marks | |
| 3,516,966 | A | 6/1970 | Berr | |
| 4,016,236 | A | 4/1977 | Nagasawa et al. | |
| 4,704,448 | A | 11/1987 | Brugel | |
| 4,816,556 | A | 3/1989 | Gay et al. | |
| 5,178,812 | A | 1/1993 | Sanford et al. | |
| 5,300,122 | A | 4/1994 | Rodini | |
| 5,871,680 | A * | 2/1999 | Macheras | B01D 67/0016 264/211.14 |
| 6,177,518 | B1 | 1/2001 | Lahijani | |
| 2011/0263729 | A1 | 10/2011 | Hermanutz et al. | |
| 2011/0287255 | A1 * | 11/2011 | Bertelo | D01F 6/665 428/401 |
| 2011/0311811 | A1 * | 12/2011 | Collette | B29C 70/025 428/373 |
| 2012/0015577 | A1 | 1/2012 | Rudman et al. | |

OTHER PUBLICATIONS

Jan. 15, 2018 Written Opinion issued in International Patent Application No. PCT/EP2017/078554.

* cited by examiner

Sample 1 Sample 1-3 Sample 1-9

PROCESS FOR THE MANUFACTURE OF POLYETHERKETONEKETONE FIBER

The present invention relates to a process for manufacturing a fiber comprising polyetherketoneketone, to a fiber comprising polyetherketoneketone, to a multifilament yarn of said fiber and to hybrid yarns and composites comprising the fiber or multifilament yarn.

Processes to manufacture polyetherketoneketone fibers and polyetherketoneketone fibers are known.

In the art, polyetherketoneketone (PEKK) is usually processed into fibers by melt-spinning processes, thus without the use of a solvent.

US2011/0311811 und US2011/0287255 describe composite fibers of PEKK and nanotubes. The fibers are produced by melt-spinning, where the PEKK is heated to above 300° C. and extruded.

U.S. Pat. No. 5,300,122 pertains to colored PEKK fibers. These fibers are also produced by melt spinning and subsequently treated with a dye.

EP0392558 discloses shaped articles made from a polymer blend of aramid and a thermally consolidable polymer. However, these articles comprise a mainly aramid polymer and only little PEKK.

US2012/0015577 A1 describes nonwovens made by melt extrusion from PEKK at extruder temperatures of 315 to 330° C.

Because PEKK has a very high melting point, melt spinning processes of PEKK require heating of the polymer at above 300° C. This process is energy-intensive and may lead to degradation of the polymer. Accordingly, the mechanical properties of PEKK fibers produced by melt spinning are not optimal.

It is an object of present invention to provide a process which avoids PEKK polymer degradation by heating and which produces fibers with improved mechanical properties. More specifically, it is desirable to obtain PEKK fibers having high elongation at break in combination with a high toughness or fibers having a very high tenacity. Furthermore, it is also desirable to manufacture PEKK yarns comprising filaments with a lower linear density and thus lower filament diameter.

These tasks are solved by a process for manufacturing a fiber comprising polyetherketoneketone comprising the steps of:

mixing polyetherketoneketone and sulfuric acid having a concentration of at least 90 wt % to obtain a spin dope and passing the spin dope through a spinneret into a coagulation bath, wherein the polyetherketoneketone is dissolved in the sulfuric acid to a concentration of 12 to 22 wt %.

In the context of the current application polyetherketoneketone (PEKK) is defined as a polymer comprising repeating units presented by Formula I and Formula II:

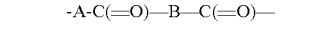

-A-C(═O)—B—C(═O)— I

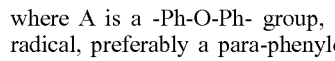

-A-C(═O)-D-C(═O)— II, where A is a -Ph-O-Ph- group, where Ph is a phenylene radical, preferably a para-phenylene radical, B is 1,4-phenylene (also referred to as para-phenylene) and D is 1,3-phenylene (also referred to as meta-phenylene). The —B—C(═O)— group is also referred to as a terephthalic moiety (T) and the -D-C(═O)— group is also referred to as an isophthalic moiety (I).

The ratio of Formula I units:Formula II units in the PEKK polymer is commonly referred to as the T/I ratio. The T/I ratio can be varied easily as may be desired to achieve a certain set of fiber properties. For example, the T/I ratio may be chosen such as to provide a lower or higher crystallinity.

Polyetherketoneketones are well-known in the art and can be prepared using any suitable polymerization technique, including the methods described in the following patents; U.S. Pat. Nos. 3,065,205; 3,441,538; 3,516,966; 4,704,448; 4,816,556; and 6,177,518. Mixtures of polyetherketoneketones may be employed.

In particular, the T/I ratio can be adjusted as desired by varying the relative amounts of the different monomers used to prepare the PEKK. For example, a PEKK may be synthesized by reacting a mixture of terephthaloyl chloride and isophthaloyl chloride with diphenyl ether. Increasing the amount of terephthaloyl chloride relative to the amount of isophthaloyl chloride will increase the T/I ratio. In another embodiment of the invention, a mixture of polyetherketoneketones is employed containing polyetherketoneketones having different T/I ratios. For example, a PEKK having a T/I ratio of 80:20 may be blended with a PEKK having a T/I ratio of 60:40, with the relative proportions being selected to provide a PEKK mixture having the balance of properties desired for the fibers.

The polyetherketoneketone may have a T/I ratio of 100:0 to 0:100. Preferably, the T/I ratio is 50:50 to 100:0, more preferably 60:40 to 90:10.

In a particularly preferred embodiment, the T/I ratio of the PEKK is from 65:35 to 85:15.

The higher the T/I ratio in the PEKK polymer, the higher the number of para-bonds in the polymer and the higher the melting point of the PEKK polymer will be. For such PEKK polymers, a melt spinning process is more difficult and requires melting at even higher temperature. Therefore, the process of the current invention is especially advantageous for PEKK having a majority of para-bonds and thus a high melting temperature.

In one embodiment the polyetherketoneketone used in the present invention has a melting temperature $T_m$ which is at least 295° C., preferably at least 310° C., more preferably at least 320° C. and even more preferably at least 330 or even at least 350° C. Generally, the melting temperature $T_m$ however does not exceed 405° C.

The melting temperature is determined by Differential Scanning Calorimetry (DSC). A 4 mg (+/−1 mg) sample is first heated from 20 to 400° C. at 20° C./min and then cooled down to 20° C. at 20° C./min. The sample is then submitted to a second heating to 400° C. at 20° C./min. The melting point is determined on the curve measured by DSC as the temperature at which the lowest heat flow is observed.

The polyetherketoneketone useful in the present invention may comprise minor amounts of other repetitive units and/or be modified with regard to its terminal functional groups.

Preferably, the polyetherketoneketone used in the invention comprises at most 15 mole % of units other than represented by Formula I and II, preferably at most 10 mole %, and in particular at most 5 mole %, most preferably at most 1 mole %. Examples of suitable other units (comonomers) are difunctional naphthalenes and chain limiting agents such as compounds comprising a benzoyl-C(═O)-Ph moiety.

Preferably, the polyetherketoneketone consists of repeating units represented by Formulas I (T) and II (I).

For the embodiment where the polyetherketoneketone consists of units represented by Formula I (T) and II (I) and the embodiment where the polyetherketoneketone comprises other units, the above described ratios for the relative amount of Formula I and Formula II repeating units preferably also apply.

Within the scope of the invention fibers are to be understood as relatively flexible, units of matter having a high ratio of length to width (across its cross-sectional area, perpendicular to its length), including all usual types of fiber, such as filaments with a length that is not particularly limited, filament yarns comprising one or more twisted, co-mingled or non-twisted filaments (monofilaments and multifilament bundles), tow made up of a collection of a large number of filaments which are bundled practically without any twist being imparted to them, and the like. Filaments of practically unlimited length formed during spinning may, if desired, be cut into staple fibers, which may in their turn be processed into spun yarns. Fiber can be cut into even smaller lengths called floc.

According to a particular embodiment, multifilament yarns may comprise PEKK fibers according to the invention and fibers of other materials. The cross section of the fiber or filament can be any shape, but is typically solid circular (round) or bean shaped.

The process according to the invention is a solvent-based process. The solvent used to dissolve the PEKK so as to form a spin dope is a water-borne solvent.

As solvent, concentrated sulfuric acid is used. Preferably, the sulfuric acid has a concentration of at least 95 wt %, more preferably at least 98 wt % and even more preferably of at least 99 wt %.

Preferably, in the process of current invention, the polyetherketoneketone and the sulfuric acid are mixed in a mixing device with a continuous flow to result in a spin dope.

The mixing device may for example be a kneader or extruder, preferably a single shaft kneader, double shaft kneader, single screw extruder or twin screw extruder.

Preferably, the mixing device is used with settings that create a high shear rate for an efficient mixing of the PEKK polymer and the sulfuric acid.

Preferably, the mixing as well as the spinning of the mixed spin dope, takes place at a temperature in the range of 20-120° C., more preferably at a temperature of 50-90° C.

Preferably, the PEKK polymer is dissolved in the sulfuric acid to a concentration of 12-22 wt %, more preferably a concentration of 15-20 wt %, even more preferably a concentration of 18-21 wt %.

The spin dope comprises a polymer fraction, which is fiber forming, and a solvent fraction. The polymer fraction comprises PEKK. Preferably, at least 60 wt % of the polymer is PEKK, more preferably, at least 70 wt %, at least 80 wt % or at least 90 wt % of the polymer is PEKK. In one embodiment, the polymer consists of PEKK. The solvent fraction comprises sulfuric acid.

According to one embodiment of the invention, the spin dope may further comprise additives, in particular stabilizers. According to another embodiment of the invention, such additives, in particular stabilizers are preferably water soluble and may be added to the coagulation bath and/or the solution used to wash the fibers.

Appropriate stabilizers are for instance phosphate salts, in particular inorganic or organometallic phosphate salts. Such phosphate salts may be selected for instance among the group consisting of ammonium, sodium, lithium, potassium, calcium, zinc, aluminum, magnesium, zirconium, barium, or rare earth phosphates. Phosphate salts may be in particular chosen among one or more of the following compounds: monosodium phosphate anhydrous, monohydrate or dihydrate; disodium phosphate anhydrous, dihydrate, heptahydrate, octahydrate or dodecahydrate; trisodium phosphate anhydrous hexagonal, anhydrous cubic, hemihydrate, hexahydrate, octahydrate or dodecahydrate; and ammonium dihydrogen phosphate.

The spin dope comprising polyetherketoneketone and sulfuric acid is processed into fibers by passing the spin dope through a spinneret into a coagulation bath. The spinning mass which is deaerated and heated to spinning temperature is spun by the known method of dry jet-wet spinning. This method is described in more detail for instance in U.S. Pat. Nos. 3,414,645 and 4,016,236 for a spin dope of para-aramid and sulfuric acid. The dry-jet wet spinning process comprises extruding the liquid spin dope into a non-coagulating gaseous atmosphere, such as air, and immediately afterwards into a coagulation bath. In the air zone (also referred to as air gap) through which the spinning mass passes, the polyetherketoneketone is drawn.

After their coagulation the filaments formed are removed from the coagulation bath, washed, dried and taken up on a bobbin.

The spinnerets that are used in the process according to the invention may be of a type known in itself in the dry jet-wet spinning of fully aromatic polyamides. The gaseous non-coagulating medium preferably consists of air.

The air gap may have a length of 2-100 mm, preferably it has a length of 4-20 mm, more preferably of 6-15 mm.

The composition of the coagulation bath may vary. It may entirely or partly consist of water or other substances, such as bases, acids, salts and organic solvents. The coagulation bath preferably consists of dilute aqueous sulfuric acid having a concentration of 0-40% by weight. According to one embodiment, the coagulation bath may consist of a diluted caustic aqueous solution e.g. an aqueous NaOH solution with a concentration of 0-10% by weight, preferably 0.05 to 5% by weight and in particular 0.1 to 1% by weight. According to another embodiment, the coagulation bath has a pH of between 4 and 11, preferably between 5 and 10 and in particular between 6 and 8. The coagulation bath may consist of water, in particular softened or demineralized water.

The temperature of the coagulation bath may have any value desired. Depending on the other spinning conditions the temperature of the coagulation bath is generally in the range of −10° C. to 50° C., and preferably between 0° C. and 25° C.

In the process according to the invention the spinning mass leaving the spinning orifices is drawn in the non-coagulating gaseous medium. The drawing ratio, that is, the ratio between the length of the filaments upon leaving the coagulation bath and the average length of the spinning mass upon leaving the spinning orifices of the spinneret may be in the range of 0.5 to 15, preferably 0.8 to 10. Depending on the other spinning conditions the drawing ratio is so chosen that as far as fiber properties are concerned optimum results are obtained.

As small amounts of residual acid may have a detrimental influence on the fiber properties, the sulfuric acid used should completely be removed from the spun fibers, in particular by neutralization and/or washing. This may be done by subjecting them to a treatment at room temperature or at elevated temperature with water and/or solutions of alkaline substances, for instance caustic solutions of NaOH, $NaHCO_3$ or $Na_2CO_3$. In one embodiment, the fibers are treated after coagulation only with solutions having a maximum pH of 11, in particular a pH of 9, preferably a pH of at most 8.5. Preferably, the fibers are only treated with water (e.g. demineralized water or softened water) after coagulation, in particular once, twice, three or more than three times (without neutralization). Fibers produced in this way may have improved mechanical properties and better thermal stability. After they have been washed, the fibers are dried. This may be done in any convenient way. It is preferred that the drying should be carried out immediately after washing, e.g. by passing the fibers over heated rollers.

The fiber obtained after drying generally has low crystallinity, usually at most 30% crystallinity, or may be amorphous.

To increase the crystallinity and the tenacity of the fibers, optionally, the fibers obtained in the process according to the invention may be subjected to a heat treatment, in which the fibers are heated under tension in an inert or non-inert gas. The heat treatment may comprise one or multiple steps of heating under tension. In one embodiment, the process according to the invention comprises heating the fiber in at least one heating step to a temperature in the range of 150 to 290° C., preferably in the range of 155 to 260° C.

In a preferred embodiment, during the at least one heating step a tension is applied which results in a drawing ratio of 1.5 to 10.

At this stage of the process, the drawing ratio may be defined as [length of the fiber after heating step]/[length of the fiber before heating step]. For a continuous online process the drawing ratio may also be determined based on the speed of the godets guiding the yarn before and after the heat treatment, thus [speed of godet after at least one heating step]/[speed of godet before at least one heating step].

The heating treatment of the fiber may comprise at least two steps. In one process according to the invention, the fiber obtained in the first heating step as described above is heated in a second heating step to a temperature in the range of 150 to 290° C., preferably in the range of 180 to 250° C.

During the second heating step a tension may be applied which results in a drawing ratio of the fiber of at most 1.5. Again, the drawing ratio is determined as described above, with the respective length or speed before and after the second heating step.

During the second heating step preferably no or only little tension is applied to the fiber, preferably just enough tension to allow transport of the fiber over process equipment, e.g. guiding rolls.

The present invention is also directed to a polyetherketoneketone fiber.

This fiber comprising polyetherketoneketone is obtainable by any of the embodiments of the above described process.

Further, current invention pertains to fibers comprising polyetherketoneketone and having a sulfur content of 0.001 to 5% by weight based on the weight of the fiber, preferably having a sulfur content of 0.01 to 2 wt %, more preferably having a sulfur content of 0.05 to 1 wt % or 0.1 to 0.5 wt %.

The PEKK fibers of the prior art which are produced by melt extrusion without the use of the solvent sulfuric acid have a lower sulfur content than the fibers of the current invention.

The sulfur content may be determined by inductively coupled plasma optical emission spectrometry (ICP-OES).

To 100 mg of fiber, 9 ml of concentrated nitric acid (70 wt %) is added. This mixture is exposed to microwave digestion in an Ultrawave (Milestone) until a clear liquid is obtained. The volume is adjusted to 25 ml by addition of MilliQ water.

Precipitates are removed from this solution by filtration. The clear filtrate is analyzed by ICP-OES in a Perkin Elmer Optima 8300 DV apparatus. For the determination of the sulfur content emission lines at 181,972 nm and 180,669 nm wavelength are used.

In one embodiment the fiber according to the invention comprises polyetherketoneketone having a melting temperature $T_m$ which is at least 295° C., preferably at least 310° C., more preferably at least 320° C. and even more preferably at least 330° C. or even at least 350° C.

In one embodiment, the current invention pertains to a fiber comprising polyetherketoneketone and having a sulfur content of 0.001 to 5 wt % and having either low crystallinity of at most 30% (or below 30%) or high crystallinity of at least 30%.

The fibers according to the invention may have a low filament linear density and a small fiber diameter, which is an advantage compared to melt spinning of PEKK fibers.

In particular, the filament diameter may be as low as 30 μm, preferably 15 μm or even lower.

The filament linear density may be as low as 10 dtex/filament, preferably as low as 5 dtex/filament, as low as 2 dtex/filament, as low as 1 dtex/filament or even lower. Fibers having a crystallinity of at most or below 30% and having a filament linear density of at most 5 dtex/filament, at most 3 dtex/filament or at most 1 dtex/filament are also encompassed by the current invention, especially if based on a polyetherketoneketone having a melting temperature of at least 310° C.

The fibers according to the invention may have a relatively high porosity and a relatively low mass density. This is advantageous in a number of circumstances, e.g. where dyeing of the fiber is required.

The fiber according to the invention may have a mass density of 1.1 to 1.4 g/cm$^3$, preferably 1.2 to 1.3 g/cm$^3$.

The mass density of the fibers is determined by the buoyancy technique using an analytical balance (e.g. Mettler Toledo AX with the Mettler Toledo Density Kit) and is based on ASTM-D3800 Method A and ASTM D792. As immersion fluid dodecane is used. The fiber sample (sample size of at least 0.3 g) is dried (100° C., vacuum) and the dry weight is determined. Subsequently, the fiber sample is placed into immersion fluid and degassed, after which the fiber sample is placed into a bath holding the immersion fluid (part of the Mettler Toledo Density Kit) and its wet weight is determined. Prior to the measurement the immersion fluid is conditioned according to ASTM D885. The density is calculated:

$$D_{specimen} = \frac{W_{dry}}{W_{dry} - W_{wet}}(D_{liquid} - D_{air}) + D_{air}$$

$W_{dry}$=mass of the dry specimen in air [g], $W_{wet}$=mass of the submerged specimen in liquid [g], $D_{specimen}$=Density of the specimen [g/cm$^3$], $D_{liquid}$=Density of the immersion liquid [g/cm$^3$], $D_{air}$=the air buoyancy is taken into account [g/cm$^3$]. The density of the immersion liquid is determined by using borosilicate glass standards.

In one embodiment, the polyetherketoneketone fiber according to the invention has a relatively low crystallinity of at most 30%. This fiber may be obtained after drying the as-spun fiber and without exposing the fiber to increased temperatures and/or tension.

In this embodiment of the fiber according to the invention, the fiber may have a crystallinity of at most 30% and a breaking tenacity of at least 50 mN/tex, preferably of at least 75 mN/tex.

The crystallinity of the as-spun, dried fibers may be at most 20% or as low as at most 10% or even at most 5%.

The crystallinity is determined by X-ray diffraction (XRD) analysis. The measurements are carried out using a P4 diffractometer with Histar area detector, using graphite-monochromated CuKα radiation and 0.5 mm collimator. The sample-detector distance is 7.70 cm (calibrated using corundum).

The obtained data are corrected for detector non-uniformity, spatial distortion and air scattering according to standard GADSS procedures.

The sample is mounted in the measuring position of the diffractometer as a bundle of parallel filaments.

Crystallinity determination is carried out using the External Crystallinity method as available in GADDS V 4.1.36 from Bruker (for specific settings see experimental section).

Another way to evaluate the crystallinity is to measure the melting enthalpy by Differential Scanning Calorimetry.

The determination method results in a relative crystallinity, i.e. not the absolute crystallinity.

The fiber having at most 30% crystallinity preferably has an elongation at break of at least 100%, preferably at least 150%, more preferably at least 200%, even more preferably at least 250%.

The elongation at break in general may be as high as 500%.

The fiber having at most 30% crystallinity preferably has a tensile energy to break (also commonly referred to as toughness or breaking toughness or toughness at rupture) of at least 100 J/g, preferably at least 125 J/g, even more preferably at least 150 J/g.

In general, the tensile energy to break may be as high as 300 J/g.

In a preferred embodiment, the fiber having at most 30% crystallinity according to the invention has a tenacity of at least 50 mN/tex, preferably at least 75 mN/tex and an elongation at break of at least 100%, preferably at least 200% in combination with a tensile energy to break of at least 100 J/g, preferably at least 125 J/g.

In another embodiment according to the invention, the fiber has a higher crystallinity. Therefore, the present invention also pertains to a fiber comprising polyetherketoneketone having a crystallinity of at least 30%, preferably at least 50%, more preferably at least 60%. In one embodiment the fiber comprising polyetherketoneketone may have a crystallinity of at least 70%.

The increase of the crystallinity may be realized by heat treatment of the fibers, e.g. by a one- or multi-step heat treatment as described for the process of the present invention.

In one embodiment, the fiber according to the invention has a crystallinity of at least 30% (or more than 30%) and a breaking tenacity of at least 150 mN/tex, preferably at least 200 mN/tex, more preferably at least 300 mN/tex, even more preferably at least 350 mN/tex.

PEKK fibers according to the invention and having a crystallinity of at least 30% may have an elongation at break of up to 100% and tensile energy to break of 10-200 J/g.

The mechanical properties of the fiber according to the invention (breaking tenacity, elongation at break and tensile energy to break) are determined in accordance with ASTM D3822-07 "Standard test methods for tensile properties of single textile fibers" after conditioning the samples at 20° C. and 65% relative humidity for 14 hours in accordance with ASTM D1776 "Practice for conditioning and testing textiles".

The current invention also encompasses a multifilament yarn comprising any fiber according to any of the above described embodiments of the current invention. Furthermore, the current invention pertains to a hybrid yarn comprising the fiber and/or multifilament yarn of the invention and at least one other fiber or multifilament yarn.

The at least one other fiber or multifilament yarn preferably has a melting temperature Tm which is at least 20° C. higher than the Tm of the PEKK fiber. The at least one other fiber or multifilament yarn may be selected from carbon fiber, glass fiber, and a fiber made from a polymer other than PEKK. The polymer other than PEKK may e.g. be aramid, cellulose or a rigid rod polymer.

In the context of the present specification aramid refers to an aromatic polyamide consisting of aromatic fragments directly connected to one another via amide fragments. Methods to synthesize aramids are known to those skilled in the art and typically involve the polycondensation of aromatic diamines with aromatic diacyl halides. Aramids may exist in the meta- and para-form, both of which may be used in the present invention.

Rigid rod (aromatic) polymers include polyazoles, such as polybenzazoles and polypyridazoles, and the like, may be homopolymers or copolymers. Suitable polyazoles are polybenzazoles such as polybenzoxazole (PBO), polybenzothiazole (PBT), polybenzimidazole (PBI) and PBO-like polymers, as e.g. poly(p-phenylene-2,6-benzobisoxazole and polyhydroquinone-diimidazopyridine.

Polybenzoxazole is a polymer containing an oxazole ring bonded to an aromatic group which is not necessarily a benzene ring. PBO-like polymers include a wide range of polymers each of which comprises a unit of a plurality of oxazole rings bonded to poly(phenylenebenzobisoxazole) and aromatic groups. PBI's and PBT's may have similar analogous structures.

In one embodiment the hybrid yarn comprises at least two multifilament yarns, where one multifilament yarn is made of PEKK.

In the hybrid yarn the at least two different fibers or multifilament yarns are combined. The at least two different fibers or multifilament yarns may e.g. be combined by twisting. Preferably, the combination results in a hybrid yarn wherein the at least two different fibers or multifilaments are intermixed, as e.g. in a commingled yarn.

Commingled yarns may be produced by air entangling or mechanical entangling. Commingling is more efficient where filaments with a smaller diameter, i.e. a lower filament linear density can be used.

The fiber, multifilament yarn and (commingled) hybrid yarn of the invention may be used for various applications, including for composite materials.

Especially the commingled hybrid yarn, e.g. commingled PEKK-carbon or PEKK-aramid yarn, is well-suited for composite materials, i.e. fiber-reinforced plastic materials. The composite materials may be used in the aerospace, automotive industry, oil and gas industry or for general industrial applications, e.g. civil engineering or building applications as fiber reinforced material. The (commingled) hybrid yarn may be placed into the desired shape to result in a preform. Alternatively, the (commingled) hybrid yarn may be braided, woven or knitted into a fabric, which may be two- or three-dimensional.

The composite is manufactured by applying heat and pressure to melt the PEKK fibers of the hybrid yarn and consolidate the composite material. After consolidation, the fibers other than PEKK remain as reinforcing fibers of the composite material while the PEKK forms a (part of) the matrix of the composite material. The commingled yard may further also be used to feed a composite additive manufacturing equipment.

The present invention is described in more detail with reference to the figures in the annex, which show:

FIG. 1: XRD patterns of PEKK fibers according to the invention. Left hand: sample 1, center: sample 1-3, right-hand: sample 1-9; and FIG. 2: Microphotograph of a PEKK fiber obtained using a melt spinning process.

The invention is described more in detail in the following examples, which should not be construed to limit the scope of present invention.

EXAMPLES

PEKK Fiber Prepared Using the Process of the Invention a)

Fibers were spun from a spin dope comprising a PEKK polymer (Kepstan 8001 sold by Arkema France) having a melt volume index according to ISO 113 at 380° C. under 5 kg of 22 $cm^3$/10 min, Tg=166° C., Tm=363° C., T/I ratio=80/20.

The PEKK polymer was mixed in a Theysohn 20 mm twin screw extruder at a temperature of 80° C. and a speed of 300 rpm with 99.8 wt % sulfuric acid to a polymer concentration of 20 w/w % to obtain a spin dope.

The spin dope was processed into filaments by passing it at 90° C. through filters and a spinneret, through an air gap and into a coagulation bath (under the conditions indicated in Table 1). The coagulation bath comprised water and had a temperature of 25° C.

TABLE 1

Settings in spin process

| Sample | Spinneret openings (number * opening diameter in μm) | Spinning speed (m/min) | Air gap (mm) | Drawing ratio in air gap |
|---|---|---|---|---|
| 1 | 25 * 125 | 90 | 10 | 4.6 |
| 2 | 25 * 125 | 50 | 6 | 3.4 |
| 3 | 25 * 125 | 50 | 6 | 5.1 |

The filaments obtained after coagulation were washed and neutralized by subsequently passing them through baths of water, 0.2% NaOH and again water. The yarns were wound in the wet state, washed offline and dried under ambient conditions on the bobbin.

The properties of the filaments obtained after drying (also indicated as "as-spun") were determined.

The mechanical properties were determined according to ASTM D3822-07 "Standard test methods for tensile properties of single textile fibers" (20 mm gage length, 10 specimen) after conditioning the samples at 20° C. and 65% relative humidity for 14 hours in accordance with ASTM D1776 "Practice for conditioning and testing textiles".

The relative crystallinity of one as-spun yarn and two heat-treated yarns was determined by XRD measurements, carried out using a P4 diffractometer with Histar area detector, using graphite-monochromated CuKα radiation and 0.5 mm collimator.

The sample-detector distance is 7.7 cm (calibrated using corundum). The data were corrected for detector non-uniformity, spatial distortion and air scattering according to standard GADSS procedures.

The sample was mounted in the measuring position of the diffractometer as a bundle of parallel filaments.

Crystallinity determination was carried out using the External Crystallinity method as available in GADDS V 4.1.36 from Bruker.

Parameters used in the crystallinity determination: background region: 2θ-range 11-27°, χ-range 133-227°; crystalline region: 2θ-range 11-28°, χ-range 79-101°.

The filament properties are shown in Table 2.

TABLE 2

Filament properties of as-spun fiber

| Sample | LD (dtex/fil.) | BT (mN/tex) | EAB (%) | TEB (J/g) | crystallinity (%) |
|---|---|---|---|---|---|
| 1 | 7.9 | 97 | 194 | 141 | 19.6 |
| 2 | 9.3 | 92 | 220 | 150 | n.d. |
| 3 | 6.3 | 93 | 255 | 172 | n.d. |

LD: linear density,
BT: breaking tenacity,
EAB: elongation at break,
TEB: tensile energy to break Fibers of sample 1 were subjected to a one-step heat treatment in $N_2$ atmosphere in an oven, at different conditions with regard to temperature and drawing ratio, the latter being realized by varying the entry and exit speed of the yarn.

The treatment conditions and the properties of the filaments after heat treatment are shown in Table 3.

TABLE 3

Properties of as-spun and heat-treated filaments

| Sample | Temp. (° C.) | DR | LD (dtex/fil.) | BT (mN/tex) | EAB (%) | TEB (J/g) | crystallinity (%) |
|---|---|---|---|---|---|---|---|
| 1 (as-spun) | — | — | 7.9 | 97 | 194 | 141 | 19.6 |
| 1-1 | 160 | 2 | 4.0 | 243 | 74 | 133 | n.d. |
| 1-2 | 160 | 2.5 | 3.3 | 285 | 34 | 78 | n.d. |
| 1-3 | 160 | 3 | 2.8 | 365 | 15 | 44 | 66.0 |
| 1-4 | 200 | 2 | 4.0 | 247 | 53 | 103 | n.d. |
| 1-5 | 200 | 2.5 | 3.3 | 295 | 30 | 70 | n.d. |
| 1-6 | 200 | 3 | 2.8 | 374 | 10 | 27 | n.d. |
| 1-7 | 250 | 2 | 4.1 | 256 | 45 | 91 | n.d. |
| 1-8 | 250 | 2.5 | 3.3 | 325 | 19 | 46 | n.d. |
| 1-9 | 250 | 3 | 2.7 | 391 | 8 | 21 | 74.7 |

Temp.: temperature used during heating step,
DR: tension applied during heating step to result in drawing ratio as indicated,
LD: linear density,
BT: breaking tenacity,
EAB: elongation at break,
TEB: tensile energy to break,
n.d.: not determined The left-hand image of FIG. 1 shows the XRD pattern of sample 1, the centre image that of sample 1-3 and the right-hand image that of sample 1-9. As can be concluded from the XRD patterns, with an increase of the temperature of heat treatment, part of the amorphous material crystallizes into a well-developed crystal structure showing 3D crystalline order while at the same time the crystallite size increases.

The method to determine crystallinity as described for the current invention results in a relative crystallinity. The as-spun PEKK yarn (sample 1) would have a much lower crystallinity if the absolute crystallinity was determined. This can be explained by the observation that the amorphous scattering shows orientation, as can be concluded by inspecting the XRD pattern of sample 1 in FIG. 1.

b)

Fibers were spun similarly to samples 1-3 from a spin dope comprising a PEKK polymer (Kepstan 7002 PF sold by Arkema France) having a melt volume index according to ISO 113 at 380° C./1 kg of 5.4 $cm^3$/10 min., Tg=158° C., Tm=333° C., T/I ratio=70/30.

The PEKK polymer was mixed in a Theysohn 20 mm twin screw extruder at a temperature of 50° C. and a speed of 300 rpm with 99.8 wt % sulfuric acid to a polymer concentration of 20 wt/wt % to obtain a spin dope.

The spin dope was processed into filaments by passing it at 50° C. through filters and at 65° C. through a spinneret (number and diameter of spinneret openings is indicated below), through an air gap and into a coagulation bath. The coagulation bath contained water.

TABLE 4

Settings in spin process

| Sample | Spinneret openings (number * opening diameter in μm) | Spinning speed (m/min) | Air gap (mm) | Drawing ratio in air gap |
|---|---|---|---|---|
| 4 | 25 * 125 | 50 | 4 | 4.96 |
| 5 | 106 * 59 | 55 | 4 | 4.43 |
| 6 | 106 * 59 | 65 | 2 | 3.72 |

The filament yarn obtained after coagulation was washed with water online. The yarns of samples 4 and 5 were neutralized with 0.25 wt % of NaOH. All samples were washed a second time with water. The yarns were dried online, heat treated at 150° C. for 5 seconds (samples 4 and 5) or 7 seconds (sample 6) and wound on a bobbin.

The mechanical properties of the yarns after drying and heating were determined according to ASTM D3822-07 "Standard test methods for tensile properties of single textile fibers" (20 mm gage length, 10 specimen) after conditioning the samples at 20° C. and 65% relative humidity for 14 hours in accordance with ASTM D1776 "Practice for conditioning and testing textiles". The sulfur content of the fibers was determined by XRF (as described above).

TABLE 5

Properties of heat treated yarns

| Sample | LD of yarn (dtex) | Filament number | BT (mN/tex) | EAB (%) | TEB (J/g) | Sulfur content (%) |
|---|---|---|---|---|---|---|
| 4 | 230 | 25 | 112 | 52 | 51 | 0.28 |
| 5 | 240 | 106 | 135 | 135 | 125 | 0.17 |
| 6 | 178 | 106 | 175 | 164 | 88 | 0.13 |

LD: linear density,
BT: breaking tenacity,
EAB: elongation at break,
TEB: tensile energy to break The filaments of all samples have a round shape (determined by microscopy of cross sections of the yarns). Especially the filaments of sample 6 have an even round shape.

Evaluation of the PEKK Fibers

The stability of the PEKK in the melt was evaluated for the PEKK fibers produced as explained above using rheological measurements.

PEKK fibers were obtained according to the process described under b) above, and were then melted and maintained during 30 minutes at 380° C. under nitrogen flush, before measuring their viscosity using a model PHYSICA MCR302-CTD450 rheometer with parallel plate geometry (at 1 Hz using plates with a diameter of 25 mm). In particular, fiber sample 5 (neutralized and washed) was tested and a fiber sample similar to sample 6 (referred to as sample 8; no neutralization, only washing with water). As a reference (sample 7), the viscosity of the PEKK polymer used to produce the fibers was measured in the same manner, after melting the polymer and maintaining it at 380° C. under nitrogen for 30 min.

The variation in viscosity is expressed as a percentage of the melt viscosity of the PEKK used to produce the fibers, submitted to the 30 minutes heat treatment. This protocol allows to evaluate the thermal stability of the fibers in the melt in stringent conditions.

The results are shown in table 6 below.

TABLE 6

Heat stability of PEKK polymer and fibers in terms of melt viscosity

| Sample | PEKK | Neutralization and washing procedure | Melt viscosity (Pa · s) | Variation (%) |
|---|---|---|---|---|
| 7 (polymer) | Kepstan 7002 PF | — | 1270 | — |
| 5 (fiber) | Kepstan 7002 PF | Washing with water, neutralization with 0.25 wt. % NaOH, washing with water | 4540 | 257 |
| 8 (fiber) | Kepstan 7002 PF | Washing withwater, no neutralization, washing with water | 2360 | 135 |

The results above show that fibers which were not neutralized and only washed with water were substantially more stable in the melt compared to fibers which are neutralized and washed. Accordingly, fibers only washed with water (without neutralization) may be used for applications with harsher requirements in terms of heat stability.

These results show that the composition of the neutralization and/or washing solution is an important factor for obtaining fibers that are sufficiently stable in the melt to be used in applications such as commingling applications for instance.

Comparative Example

PEKK Fiber Obtained Using Melt Spinning

The PEKK polymer used in sample 1 was melt spun at 400° C. using a DSM microcompounder and a DSM fiber conditioning unit.

Figure 2:
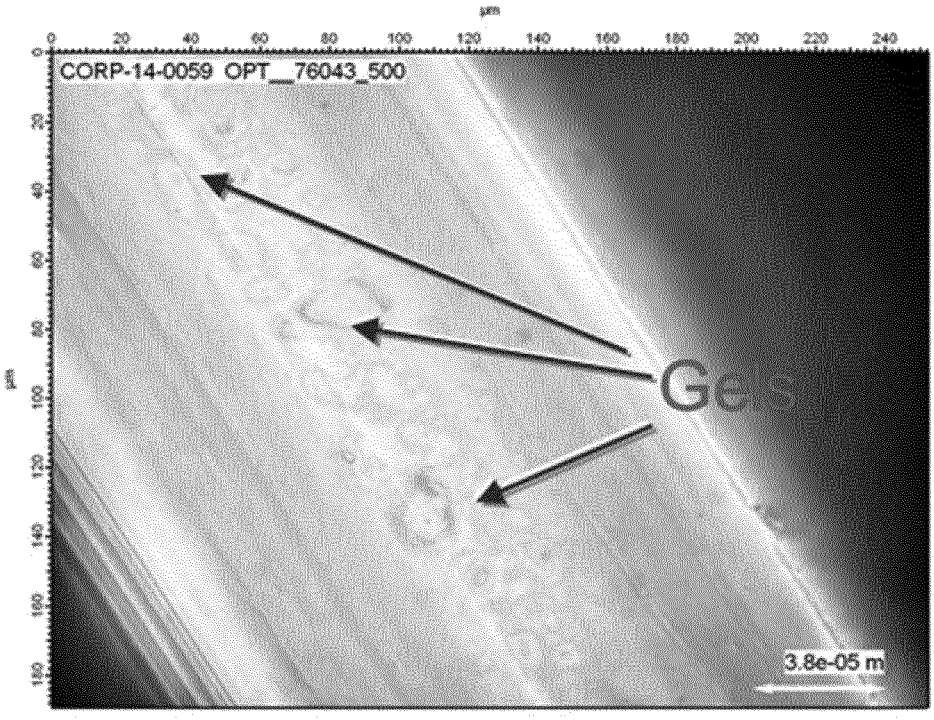

As apparent from FIG. 2, the fibers obtained by melt spinning have an uneven surface with several defects. Without wishing to be bound by this theory, it is presently assumed that the defects correspond to regions where the polymer has formed a gel following thermal degradation and subsequent crosslinking.

The average fiber diameter of the fibers obtained was 140 μm.

The invention claimed is:

1. A process for manufacturing a polyetherketoneketone fiber comprising the steps of:

mixing polyetherketoneketone and sulfuric acid having a concentration of at least 90 wt % to obtain a spin dope and passing the spin dope through a spinneret into a coagulation bath, wherein the polyetherketoneketone is dissolved in the sulfuric acid to a concentration of 12 to 22 wt %, wherein the spin dope comprises a polymer fraction and at least 60 wt % of the polymer fraction is polyetherketoneketone.

2. The process according to claim 1, wherein the polyetherketoneketone comprises repeating units represented by Formula I and Formula II:

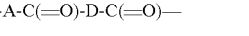

-A-C(=O)—B—C(=O)— I

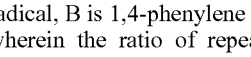

-A-C(=O)-D-C(=O)— II, where A is a -Ph-O-Ph- group, where Ph is a phenylene radical, B is 1,4-phenylene and D is 1,3-phenylene and wherein the ratio of repeating units represented by Formula I:Formula II is 100:0 to 0:100.

3. The process according to claim 1, wherein the polyetherketoneketone has a melting temperature $T_m$ which is at least 295° C.

4. The process according to claim 1 further comprising heating the fiber in at least one heating step to a temperature in the range of 150 to 290° C.

5. The process according to claim 4, wherein during heating step, a tension is applied which results in a drawing ratio of 1.5 to 10.

6. The process according to claim 4, wherein the fiber is heated in a second heating step to a temperature in the range of 150 to 290° C.

7. The process according to claim 6, wherein during the second heating step a tension is applied which results in a drawing ratio of the fiber of at most 1.5.

8. The process according to claim 1, wherein the fiber after coagulation is only treated with solutions having a pH of at most 11.

9. The process according to claim 1, wherein the spin dope comprises a polymer fraction and at least 70 wt % of the polymer fraction is polyetherketoneketone.

10. The process according to claim 1, wherein the spin dope comprises a polymer fraction and at least 90 wt % of the polymer fraction is polyetherketoneketone.

* * * * *